US006063993A

United States Patent [19]

Hoshino

[11] Patent Number: 6,063,993

[45] Date of Patent: May 16, 2000

[54] INSTALLATION STRUCTURE OF A CONNECTING BELT FOR A DRUM PEDAL

[75] Inventor: Yoshihiro Hoshino, Nagoya, Japan

[73] Assignee: Hoshino Gakki Kabushiki Kaisha, Nagoya, Japan

[21] Appl. No.: 09/177,810

[22] Filed: Oct. 23, 1998

[30] Foreign Application Priority Data

Mar. 5, 1998 [JP] Japan ..... 10-073383

[51] Int. Cl.[7] ..... G10D 13/02

[52] U.S. Cl. ..... 84/422.1; 84/422.3; 84/422.2

[58] Field of Search ..... 84/422.1, 422.2, 84/422.3, 411 R, 411 A, 327, 453

[56] References Cited

U.S. PATENT DOCUMENTS

| | | | |
|---|---|---|---|
| 1,128,142 | 2/1915 | Hubmann | 84/422.1 |
| 1,309,082 | 7/1919 | Williams | 84/422.1 |
| 1,360,031 | 11/1920 | Scheurer et al. | 84/422.1 |
| 2,132,211 | 10/1938 | Hueckstead | 84/422 |
| 2,581,515 | 1/1952 | Christian | 84/422 |
| 2,784,634 | 3/1957 | Della-Porta | 84/422 |
| 3,055,254 | 9/1962 | Haviland | 84/422 |
| 3,930,431 | 1/1976 | Magadini | 84/422 |
| 4,788,897 | 12/1988 | Kirby et al. | 84/422 R |
| 4,846,040 | 7/1989 | Hoshino | 84/422.1 |
| 5,509,342 | 4/1996 | Augsburger | 82/422.1 |
| 5,557,054 | 9/1996 | Shigenaga | 84/422.1 |

FOREIGN PATENT DOCUMENTS 1004026 3/1957 Germany .

OTHER PUBLICATIONS

Rogers Catalog, 1964.

*Primary Examiner*—Robert E. Nappi
*Assistant Examiner*—Kim Lockett
*Attorney, Agent, or Firm*—Ostrolenk, Faber, Gerb & Soffen, LLP

[57] ABSTRACT

An installation structure for a connecting belt for a drum pedal extending between the swingable tip of the drum pedal and a wheel secured to the drum beater rotary shaft such that movement of the pedal rotates the wheel to rotate the shaft to bang the drum beater on the drum. Loops are formed at each end of the connecting belt. A pin passes through each loop. A respective concave formed on the underside of the pedal and on the wheel receives a respective one of the pins and the belt looped thereon. A removable holder secures each of the pins and the belt thereon in the respective concaves on the pedal and the wheel.

10 Claims, 6 Drawing Sheets

INSTALLATION STRUCTURE OF A CONNECTING BELT FOR A DRUM PEDAL

BACKGROUND OF THE INVENTION

This invention relates to an installation structure for a connecting belt for a musical instrument, namely a drum pedal.

PRIOR ART EMBODIMENT

FIG. 6 shows a drum pedal of the prior art for use with a bass drum. The drum pedal includes a rotary shaft 58 that is located between two supports 52 which are erected on both sides of a base 51 of a drum pedal 50. A beater support 53 and a wheel 54 are secured next to each other on the rotary shaft 58. A connecting belt 60 has one end region wound on the outer periphery of the wheel 54, and has its other end connected to the free end of a swingable pedal plate 57.

As the pedal plate 57 is stepped on, it swings down in the direction of arrow A. This pulls down the connecting belt 60 which rotates the wheel 54 along with the rotary shaft 58 as the center of the wheel. The beater support 53 rotates integrally with the rotary shaft 58 until the drum surface D is beaten by the beater 55 supported on the support 53. A screw 56 secures the beater 55 to the beater support 53.

The connecting belt 60 is mostly comprised of a belt made of leather or cloth. As the connecting belt 60 has the flexibility and softness which are characteristic of the material employed, the performer likes the soft step feeling and easily operability that stem from it. This has the further advantage that little noise is generated when the belt contacts the wheel 54 during a performance.

However, a connecting belt 60 made of leather or cloth may be mutilated during a performance. For this kind of connecting belt 60, it has been customary to form a through hole 62 at both ends of the belt and to secure the belt ends to the wheel 54 and the pedal plate 57 by means of a respective fixing screw 63 through each through hole. As a result, stress is concentrated at the through holes 62 in the belt 60 and the area around a through hole 62 becomes weakened until it tends to be elongated or develops cracking, even leading to its rupture in some cases.

To cope with this problem, a metal link chain has been used as a substitute connecting member. The connecting member in the form of a chain has both strength and durability and its appearance is satisfactory. As compared with a connecting belt 60, however, the operating feel of a chain is rigid, and noise is inevitably generated when a chain is used. Therefore, connecting member of the belt type are preferred by many performers.

SUMMARY OF THE INVENTION

In view of the above described circumstances, the invention provides a connecting belt which is durable and has such strength as to not rupture easily at the installation part of the connecting belt.

In the installation structure of a connecting belt for a drum pedal, a connecting belt is installed between the installation part on the tip of a pedal plate and the installation part on the wheel on the rotary shaft. The belt has a loop formed at each end. An engaging pin is provided in each loop. A respective receptacle in the form, for example, of a concave region that accommodates and engages both ends of each engaging pin is formed at both the pedal-side installation part and the wheel-side installation part. A respective holding member compressively secures each engaging pin at its respective concave region so that the pin is freely movable.

In addition, both engaging pins and both holding members are comprised of the same member at the pedal-side installing part and at the wheel-side installing member.

Other objects and features of the invention are explained below with reference to the attached drawings.

DESCRIPTION OF A PREFERRED EMBODIMENT

Figure 1:
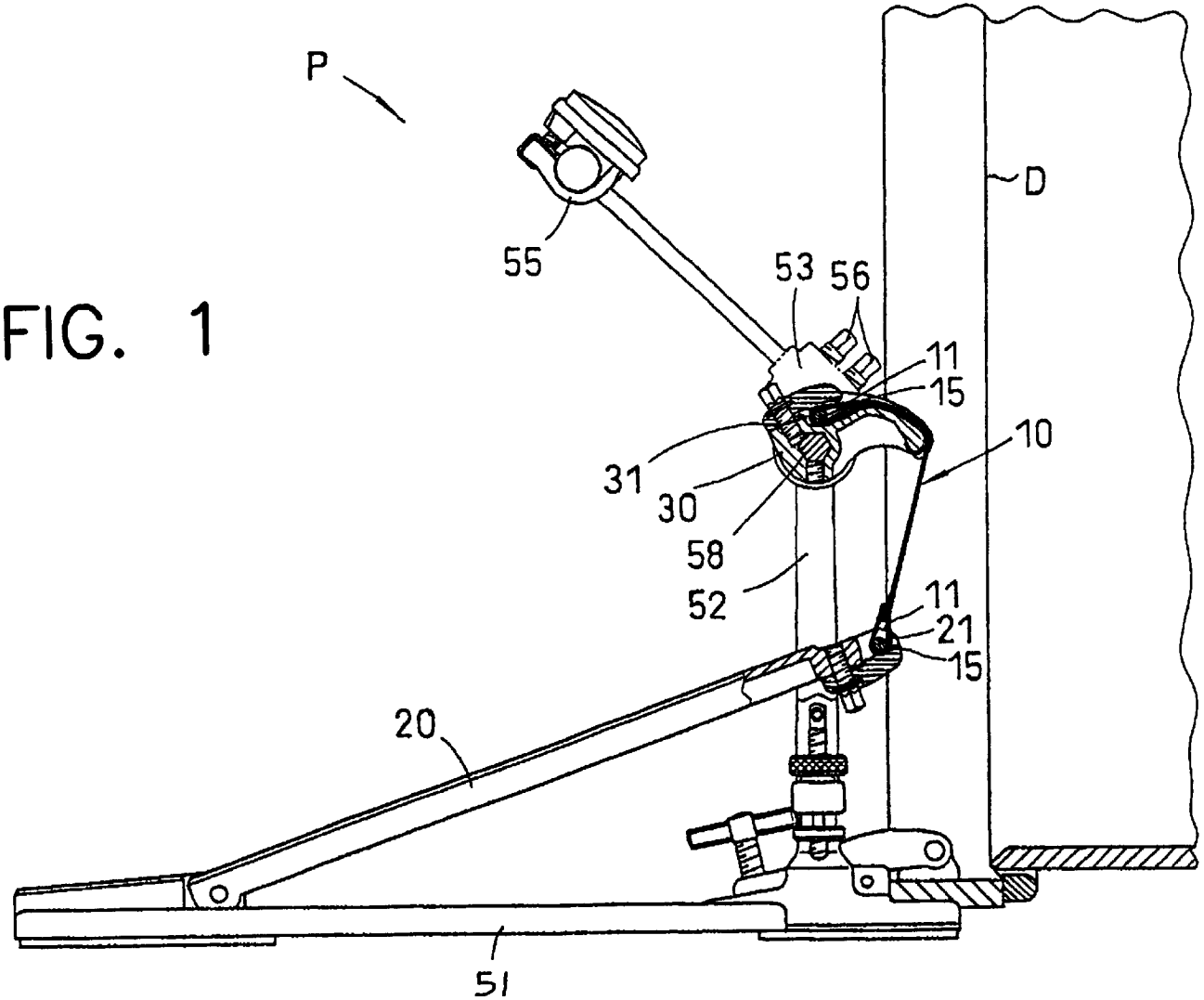
FIG. 1 is a partial cross section showing essential parts of a drum pedal according to the invention.
Figure 6:
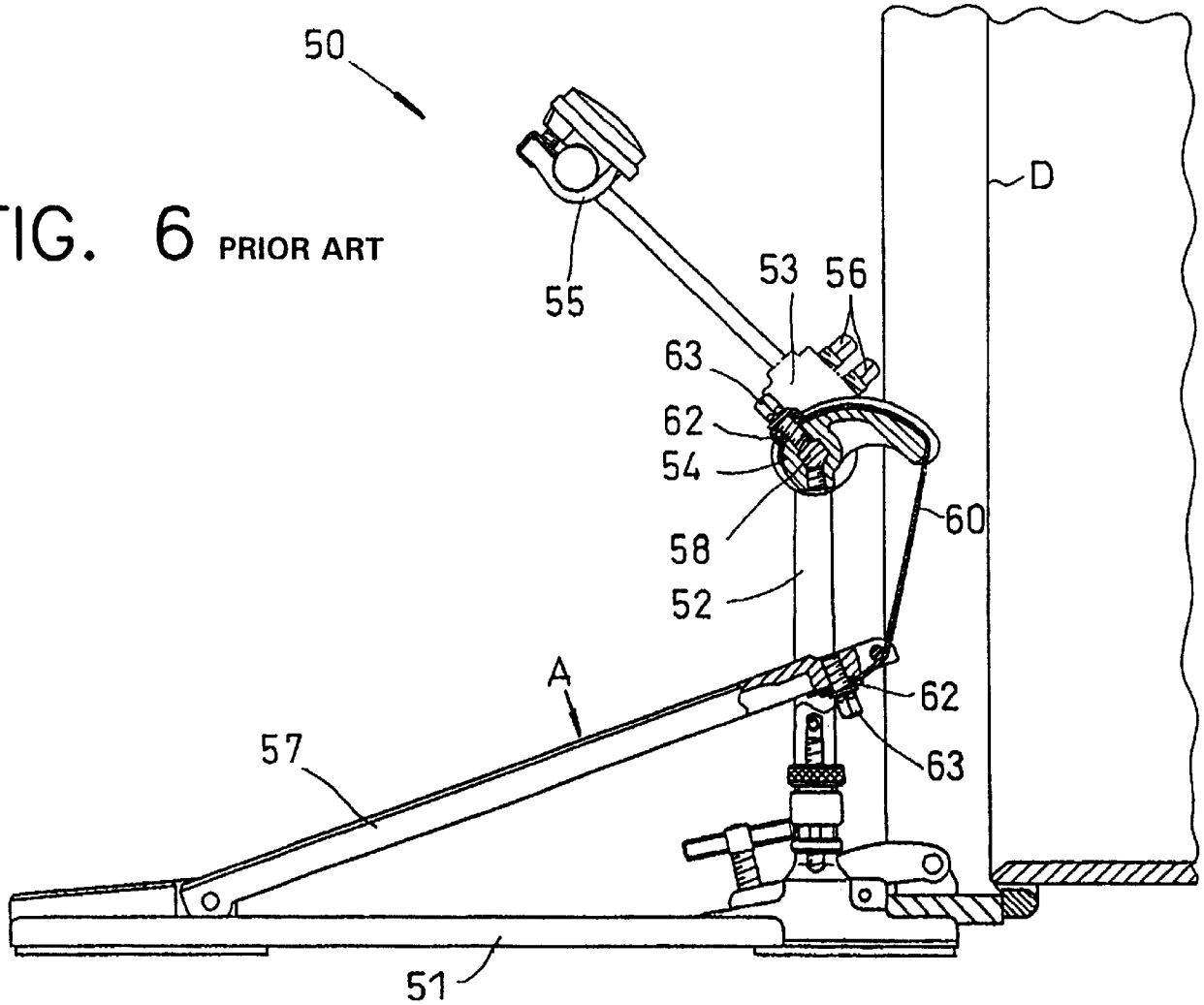
FIG. 6 PRIOR ART
FIG. 6 is a cross section showing the essential parts of a drum pedal according to prior art.

The drum pedal P shown in FIG. 1 has the same structure as the prior art drum pedal 50 that has been earlier described in connection with FIG. 6. The same reference numbers are used without further explanations of the same elements.

The rotary shaft 58 is between the supports 52 which are erected on both sides of the base 51. The beater support 53 and the wheel 30 are provided on the rotary shaft 58. A connecting belt 10 is fixed at a wheel side installation part 31 on the outer periphery of the wheel member 30 on the rotary shaft 58. The other end of the connecting belt 10 is secured to the installation part 21 at the swinging tip of the pedal plate 20.

Folded over belt loops are formed at the opposite ends of the belt 10. The connecting belt 10 has respective engaging pins 15 provided at the loops 11 at both ends. The engaging pins 15 are compressively fixed in receptacles, e.g. in the form of concaves or grooves 22 and 32, which are formed at the pedal-side installation part 21 and the wheel-side installation part 31 respectively, in FIGS. 2 and 4.

The connecting belt 10 is comprised of either leather or cloth. Both of its ends are folded back to define the loops 11 which are sewed together with thread, etc. An engaging pin 15 is provided in each loop 11. Each loop 11 can be of any size, as long as it permits insertion of its engaging pin 15 and fastening of the end loops is not limited to having been sewn together with thread, etc.

The engaging pins 15 are of metal, etc. and each is of such length that both of its ends 15*a* may protrude from the respective lateral edge of each loop 11 by a prescribed length.

Figure 2:
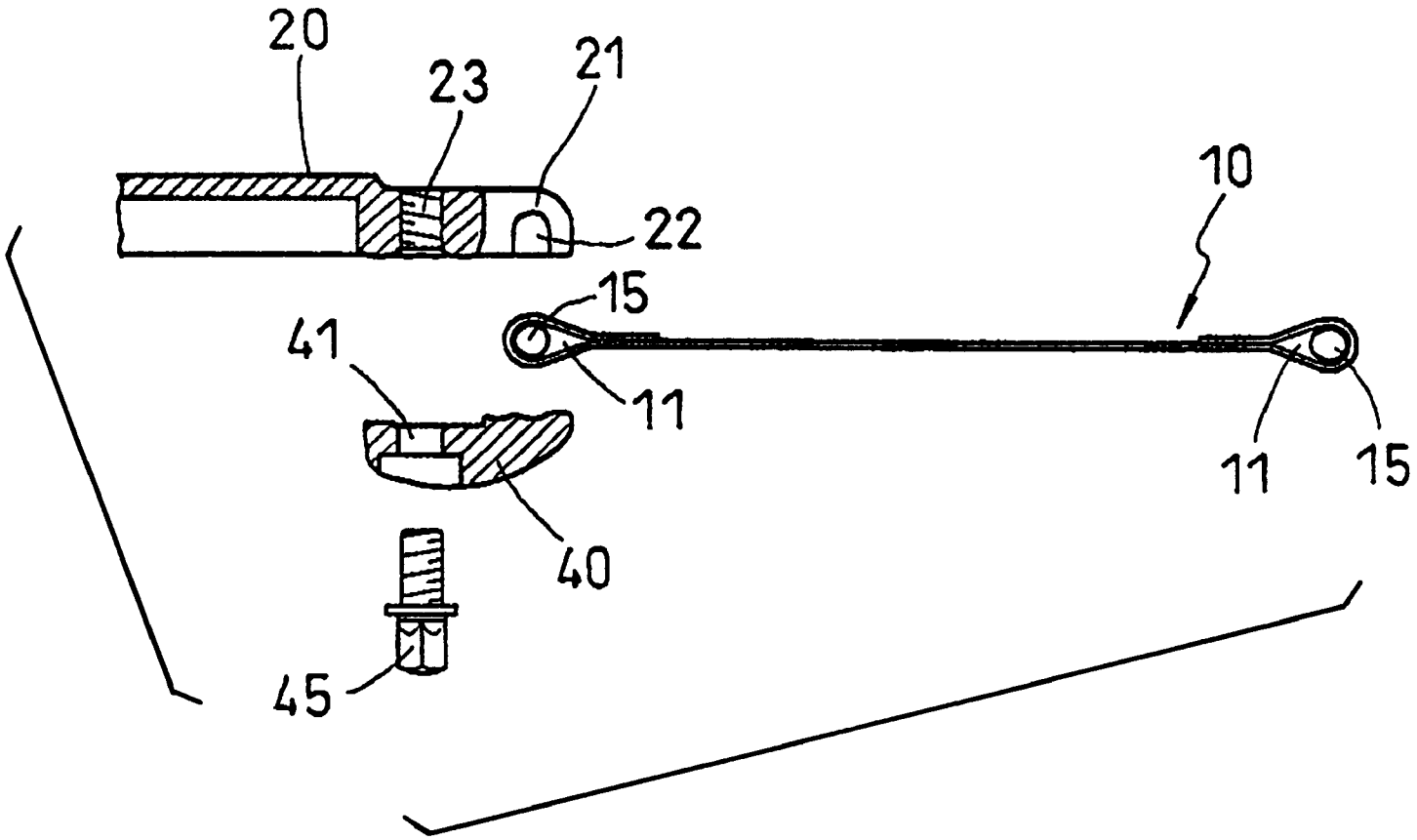
FIG. 2 is an exploded cross sectional view showing an essential part of the fixing arrangement on the pedal side and in an enlarged fashion.

At the pedal-side installation part 21, the tip of the bottom side of the pedal plate 20 has a U-shape, as seen in FIGS. 2 and 3. At both lateral sides, concave recesses 22 accommodate the engaging pins 15 of the connecting belt 10. A holder 40 presses on the belt loop 11 and holds the engaging pins 15 in the concaves 22 to also be freely removable. Screw holes 23 and 41 receive a fixing screw 45 for fixing the holder 40 to the part 21.

Figures 3A, 3B, 3C:
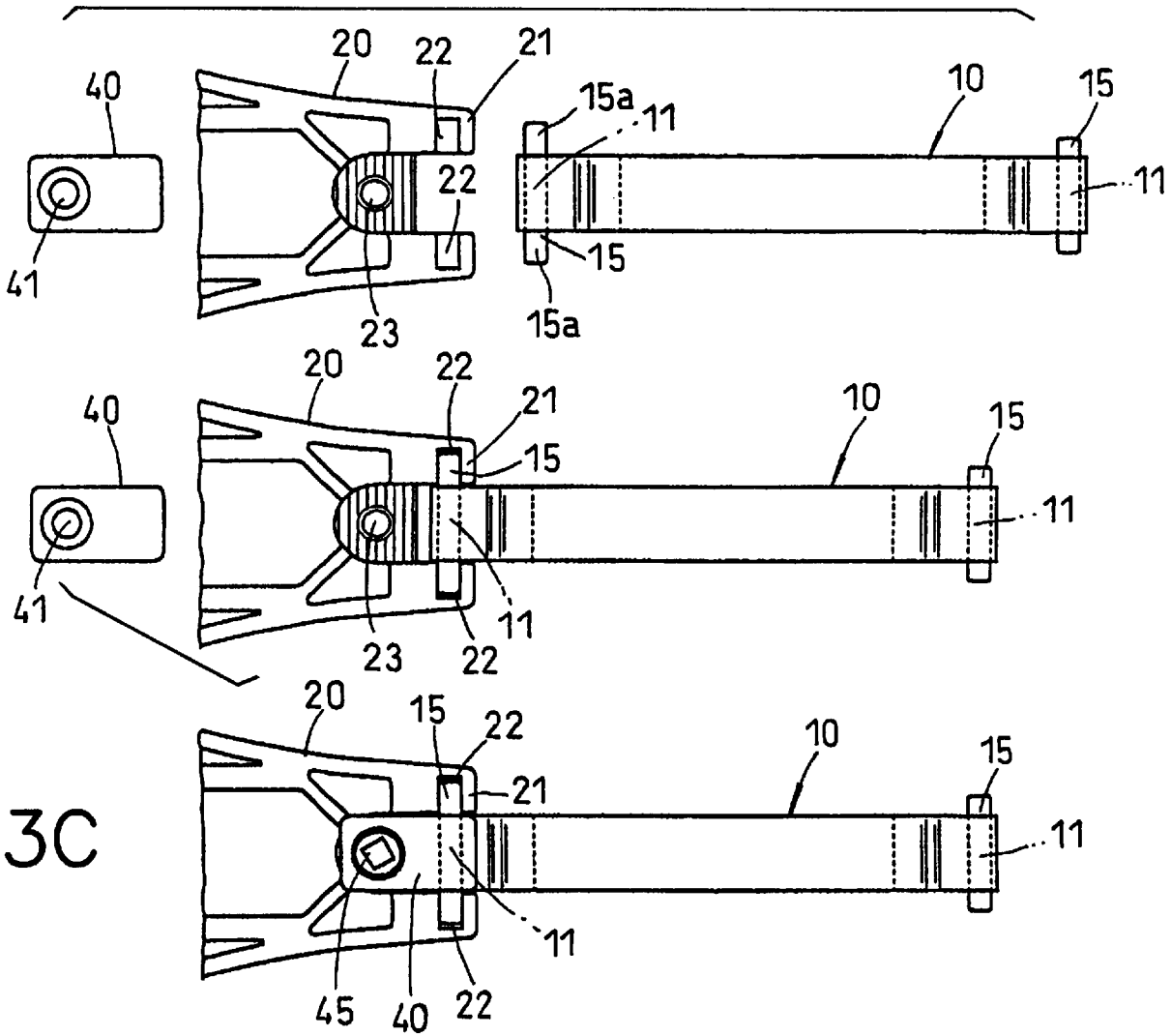
FIGS. 3A, B, and C are bottom plan views showing the underside of the tip of the pedal plate at installation.

The installation part 21 on the pedal side includes an engaging pin 15 in the loop 11 of the connecting belt 10, as is shown by FIG. 3A. Both ends 15*a* of the engaging pin 15, which protrude from the loop 11, are received in the concaves 22 on the bottom side of the pedal plate 20 as shown in FIG. 3B.

Next, the holding member 40 is placed over the concaves 22, as shown in FIG. 3C, then the fixing screw 45 is tightened. As a consequence, one end of the connecting belt 10 can be fixed to the pedal-side part 21.

Figure 4:
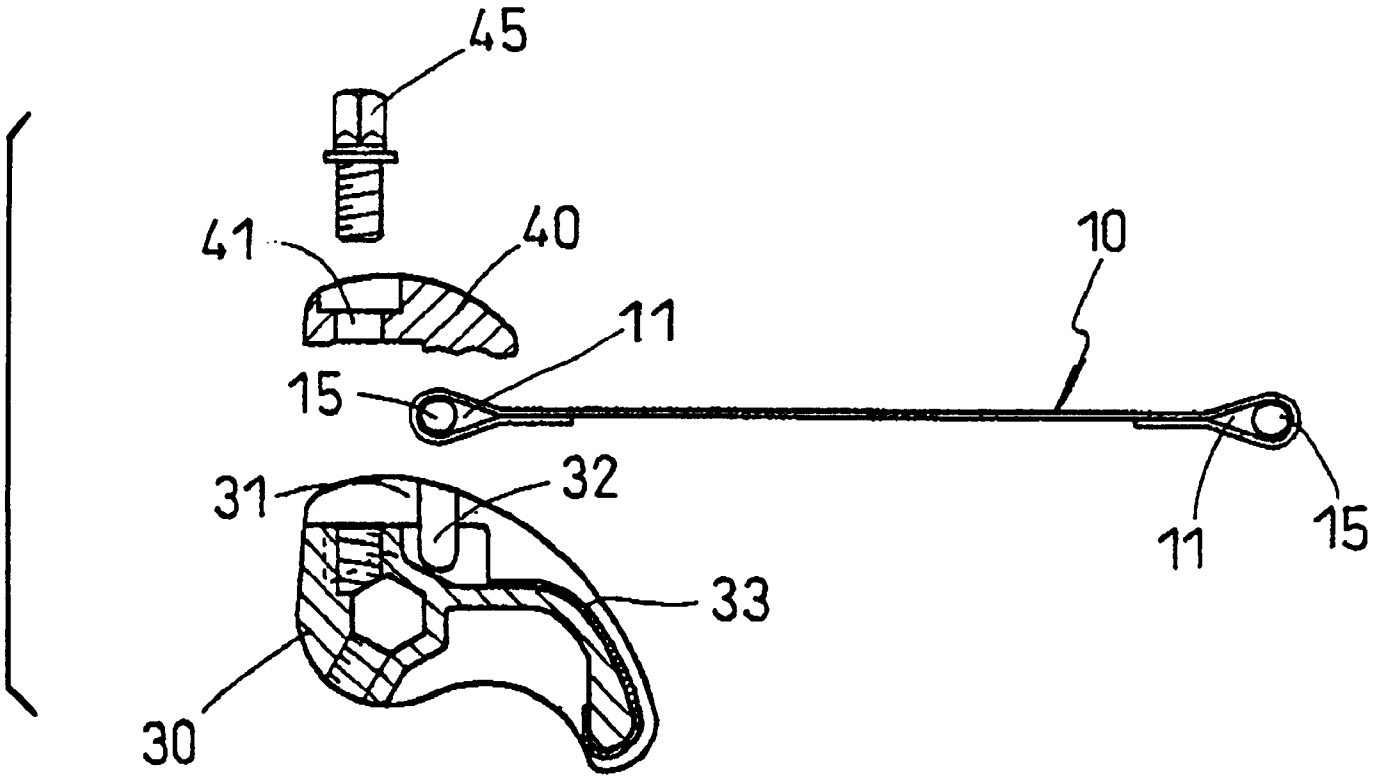
FIG. 4 is a cross section showing the essential part of the fixing arrangement on the wheel side and in an enlarged fashion.

In addition, the wheel-side installation part 31 has concaves 32 for accommodating the respective engaging pin 15. These concaves are formed in the surface of the wheel 30, as shown in FIGS. 4 and 5. A holder 40 covers the pins 15 in the concaves 32. The holder 40 is secured to the part 31 by a fixing screw 45. It is desirable to install a buffer, e.g. of felt, etc., 33 having a sound arresting effect on the surface where the connecting belt 10 is wound on the outer periphery of the wheel 30.

For the engaging pin 15 and the holder 40, it is advantageous from the standpoint of manufacture to use a material which is used both on the pedal-side installation part 21 and on the wheel-side installation part 31. The parts where the engaging pin 15 and the holder 40 are to be installed at the pedal-side installing part 21 and the wheel-side installation part 31 also have corresponding shapes.

Figure 5A:
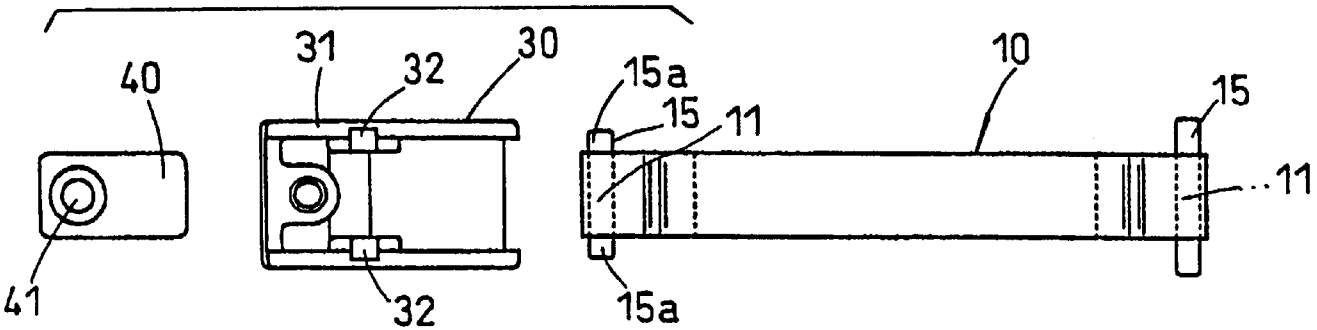
FIGS. 5A, B and C are top plan views showing the state of installation on the top of the wheel.
Figure 5B:
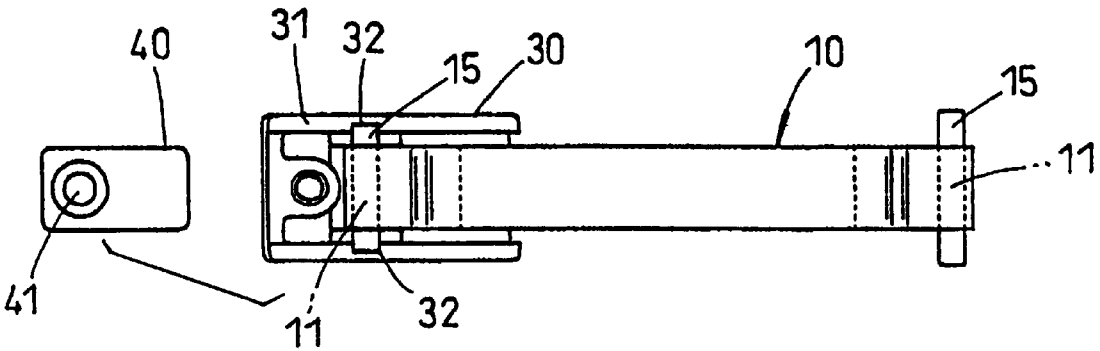
Figure 5C:
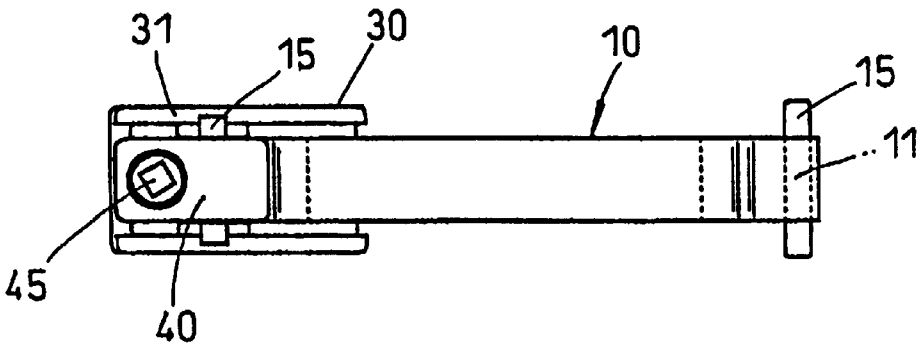

The method of installing the connecting belt member 10 in the wheel-side installation part 31 is about the same as for installation of the pedal-side installation part 21. As is shown in FIGS. 5A and 5B, both ends 15*a* and 15*a* of the engaging pin 15 which protrude beyond the edges of the loop 11 of the connecting belt 10 are accommodated in the concaves 32 and 32 at the top of the wheel 30. As shown in FIG. 5C, a holder 40 is arranged above them. As the holder is tightened with a fixing screw 45, the connecting belt 10 is secured to the wheel-side installation part 31.

The connecting belt 10 for the drum pedal P is installed in the manner described above and is fixed to each installation part through the engaging pin 15 that has been provided in the loop 11. Therefore, the force applied by stepping on the pedal plate 20 is evenly applied across the entire width of the connecting belt 10. This increases both the tensile strength and durability of the belt, as compared with the prior art belt.

In the installation structure for the connecting belt for a drum pedal according to the invention, engaging pins, which are accommodated in loops that are provided at both ends of the connecting belt, are accommodated and engage in concaves that are formed at each installation part. The pins are further pressed and secured by means of respective holders, as explained above. Accordingly, this improves the tensile strength and durability of the belt and the belt is installed firmly in such a way that will make it difficult to break the belt.

In addition, both manufacturing economy and operability can be improved by making the engaging pins and the holders as common or the same parts to be used at both the pedal-side and the wheel-side installation parts.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. An installation for a connecting belt for a drum pedal, wherein:

the drum pedal includes a plate having one end pivotally mounted on a pivot and an opposite swingable end which is swingable around the pivot; the drum pedal further comprising a rotary shaft spaced from the swingable end of the pedal and supported for rotation; a beater on the shaft for being rotated by rotation of the shaft for beating a drum; and a wheel on the shaft which is rotatable with the shaft;

the connecting belt comprising a flexible belt having ends, a respective loop of the belt formed at each belt end, a respective engaging pin disposed in each loop and of a length to extend beyond the edge of the belt at the respective loop;

a pedal-side installation part formed at the swingable end of the pedal plate, the pedal-side installation part forming a first receptacle to receive the loop at one end of the belt and the pin therein;

a pedal-side holder covering the belt loop received in the first receptacle and pressing the respective pin and the belt loop into the first receptacle of the pedal-side installation part;

a wheel-side installation part formed on an outer periphery of the wheel, the wheel-side installation part forming a second receptacle to receive the loop at the other end of the belt and the respective pin therein, whereby the belt is held to and is connected between the pedal and the wheel; and a respective wheel-side holder covering the belt loop received in the second receptacle and pressing the respective pin and the belt loop into the second receptacle of the wheel-side installation part.

2. The installation structure of claim 1, wherein the first receptacle comprises a respective concave formed in the pedal for receiving the pedal-side pin and the belt wrapped therearound.

3. The installation structure of claim 2, wherein the concave is disposed on the side of the pedal that is opposite the side of the pedal that is toward the wheel.

4. The installation structure of claim 2, wherein the second receptacle comprises a respective concave formed in the wheel for receiving the wheel-side pin and for receiving the belt wrapped around the pin at the wheel side.

5. The installation structure of claim 1, wherein the holders are removably secured to the pedal plate and the wheel.

6. The installation structure of claim 4, wherein the wheel includes a lip thereon beyond the concave and the belt wraps around the lip before the belt extends off the wheel and toward the pedal.

7. The installation structure of claim 6, further comprising a noise diminishing surface on the lip where it is contacted by the belt.

8. The installation structure of claim 1, wherein both engaging pins and both holders for the engaging pins are corresponding commonly shaped elements of the same material.

9. The installation structure of claim 1, wherein the belt is comprised of leather or cloth.

10. The installation structure of claim 1, wherein each of the loops is a closed loop around the respective engaging pin.

* * * * *